United States Patent [19]

Magnant et al.

[11] Patent Number: 4,868,955

[45] Date of Patent: Sep. 26, 1989

[54] DEVICE FOR STABILIZING A CLUSTER OF ARTICLES

[76] Inventors: Gregory A. Magnant, P.O. Box 102 - 413A Francis Ave., Cascade, Wis. 53011; Robert H. Ramstack, 3300 N. Dousman St., Milwaukee, Wis. 53212

[21] Appl. No.: 163,511

[22] Filed: Mar. 2, 1988

Related U.S. Application Data

[63] Continuation-in-part of Ser. No. 133,244, Dec. 10, 1987, abandoned, which is a continuation of Ser. No. 920,182, Oct. 17, 1986, abandoned.

[51] Int. Cl.[4] ..... A44B 21/00

[52] U.S. Cl. ..... 24/306; 24/302; 206/597

[58] Field of Search ..... 24/16 R, 16 PB, 20 R, 24/23 B, 305, 298, 302, 442, 306, 300, 301; 108/55.1; 248/205.2, 102; 410/96–98, 32, 34, 35; 206/597; 128/DIG. 15

[56] References Cited

U.S. PATENT DOCUMENTS

| | | | |
|---|---|---|---|
| 920,328 | 5/1909 | Hines | 24/16 R |
| 1,241,301 | 9/1917 | Taylor | 24/23 B |
| 2,879,990 | 3/1959 | Eaton | 24/302 X |
| 3,371,815 | 3/1968 | Macomber | 206/597 X |
| 3,731,348 | 5/1973 | Luehne | 24/442 X |
| 3,835,505 | 9/1974 | Shewbridge | 24/302 X |
| 3,947,927 | 4/1976 | Rosenthal | 24/306 |
| 4,270,657 | 6/1981 | Bayon | 108/55.1 X |

FOREIGN PATENT DOCUMENTS

| | | | |
|---|---|---|---|
| 405131 | 7/1966 | Switzerland | 24/302 |

*Primary Examiner*—James R. Brittain

*Attorney, Agent, or Firm*—Fuller, Puerner & Hohenfeldt

[57] ABSTRACT

A sheet of loop material such as is used in Velcro is fastened to an elongated flexible belt on one side and at near one end of the belt. At least one sheet of hook material is fastened to the opposite side of the belt near the other end. A strap is fastened to one end of the belt. The strap has a metal hook fastened to its free end. The hook can be used to attach the belt to one of a cluster of articles that should be stabilized during transportation such that the belt can be wrapped around the articles snugly to bring the sheet of hook material into engagement with the sheet of loop material so that the belt holds all of the articles together. The strap has a strip of Velcro hook material and an adjacent strip of Velcro loop material fastened to it. The loop and hook materials can be brought around to form a bight by engaging the loops and hooks.

2 Claims, 4 Drawing Sheets

DEVICE FOR STABILIZING A CLUSTER OF ARTICLES

This is a continuation-in-part application of Ser. No. 133,244, filed Dec. 10, 1987, abandoned which is a continuation of parent application Ser. No. 920,182, filed Oct. 17, 1986, abandoned.

BACKGROUND OF THE INVENTION

The invention disclosed herein is for stabilizing a cluster of articles, particularly, when the articles are being transported on a vehicle such as a cart of lift truck.

In commercial and industrial establishments a cluster of similarly shaped or differently and irregularly shaped boxes or cartons or other objects must be transported from one place to another. One common illustrative example arises in retail stores such as supermarkets where a large number of articles such as boxes containing food are transported on a hand pushed cart from a storage area to shelves in the supermarket where the articles are deposited for being displayed to customers. A collection of differently shaped or irregularly shaped articles is especially unstable. Usually, the supermarket employee will attempt to stack as many articles on a cart that he or she thinks can be transported without slipping and falling off of the cart. Generally, the employee will be careful to not accelerate nor decelerate the cart at a rate that would cause the articles to slip and fall off but the need for exercising this kind of care just increases the time required to transport the articles to their destination. As has frequently been observed, despite exercising of due care, turning the cart too rapidly or bumping into shelving results in the articles being spilled off of the cart. Besides the possibility of damaging the articles, the nonproductive act of replacing the articles on the cart must be undertaken. There are occasions when simply running a cart or truck over a rough surface in a warehouse for example, causes the load of articles to fall off of the vehicle.

Notwithstanding the fact that keeping a cluster of articles from falling off of the vehicle while they are being transported has been a perennial problem, no one has provided a convenient device for stabilizing a cluster or stack of articles while they are being transported.

SUMMARY OF THE INVENTION

The main objective of the present invention is to provide a device that can be applied quickly and easily by only one person to a cluster of articles for holding them together in stable form while they are being transported.

Briefly stated, the new device comprises a belt of fabric or some other flexible sheet material that is usually, but not necessarily, rectangular in form. On one side and near one end of the belt at least one sheet of a hook material is applied and on the other side of the belt near the opposite end a sheet of loop material is fastened. The hook and loop materials compose, for example, the attachment means commonly known by the trademark "Velcro." A strap has one of its ends fastened to an end, preferably, of the belt. In the described embodiment, a c-shaped hook is fastened to the free end of the strap. The hook and strap can be used to anchor one end of the fabric belt while the belt is being wrapped around a stack or cluster of articles that are to be transported. Because the belt is anchored at one end of the strap, the belt can be stretched in tension as it is being wrapped around the cluster of articles until the hook material on one side of the belt interfaces with the loop material on the other side of the belt so that the hook and loop materials can be engaged to hold the articles together.

A more detailed description of a preferred embodiment of the new article stabilizing device will now be set forth in reference to the drawing.

DESCRIPTION OF A PREFERRED EMBODIMENT

Figure 1:
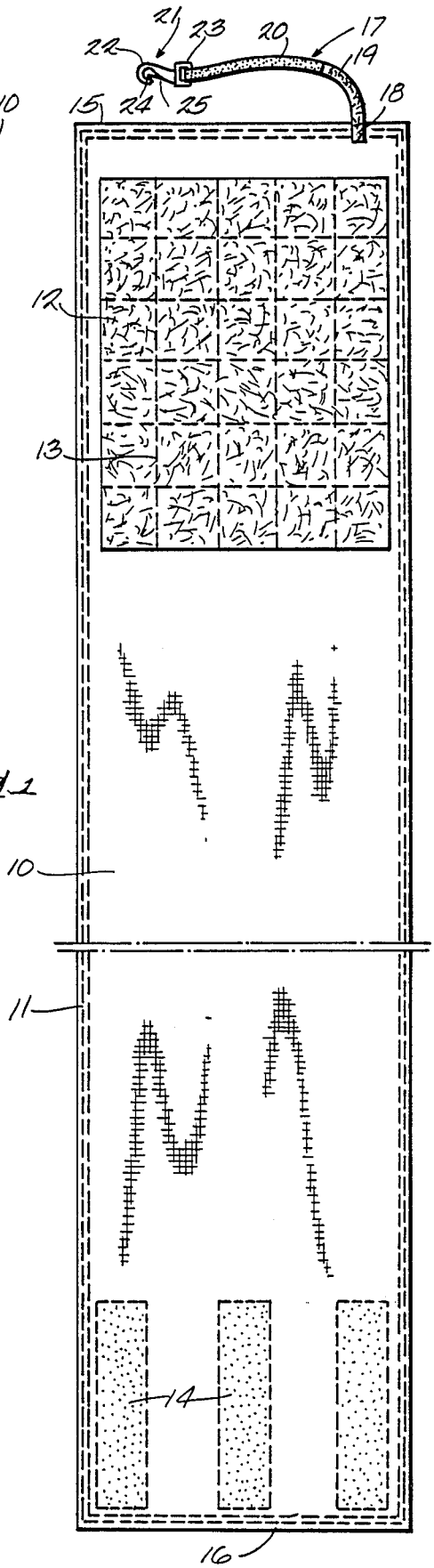
FIG. 1 is a plan view of the article stabilizing device.

The stabilizing device in FIG. 1 comprises a rectangular belt of tough fabric such as nylon. By way of example and not limitation, in a commercial embodiment of the device a nylon known by the tradename of "Rip-Stop" of approximately 1/10 mm in thickness is used. Other tough flexible sheet materials could be used for belt 10. The edges of the belt are double folded to form a strong hem 11 are formed and then the hem is double-stitched. At one end 12 of belt 10 a sheet of loop material 12 is sewn onto belt 10. The sheet of loop material 12 may be the same as or comparable to the loop material composing the attachment means known by the trademark "Velcro." In FIG. 1, the loop material is on the top side of fabric belt 10. It is sewn onto belt 10 securely by the criss-crossed stitches marked 13. The large area of loop material 12 is thus fastened securely to belt 10. At the other end of the stabilizing belt 10 and on the side opposite of the loop material 12, there are, in the illustrated embodiment, three bands of hook material, one of which is marked 14. The loop material 12 is fastened near one end 15 of belt 10 and the hook material 14 is arranged near the other end 16 of the belt. Thus, when the belt 10 is wrapped under tension around a group of articles such as the stacks of boxes 16 in FIG. 2, the hook material 14 will overlay the loop material 12. Pressing the hook and loop materials together attaches them securely as is a well known property of the components of Velcro.

In FIG. 1, a strap 17 is fastened by sewing at 18 to the end 15 of belt 10. There is a strip of loop material 19 fastened to strap 17 and there is also an adjacent strip of hook material 20 fastened to strap 17. A fastener 21 that terminates in a metal hook 22 has an eye 23 through which the end of strap 17 is looped to secure the metal hook 21 to the strap 17. The hook portion 22 is c-shaped and terminates in a tip 24 which is preferably sharpened. Hook 21 may be the well known marine swivel bolt snap which has a flat spring 25 for closing the hook and preventing the hook from detaching to whatever it may be attached. Although a swivel hook offers some advantages, an ordinary hook with a sharpened tip could be used since the flat spring 25 is not absolutely essential to utilizing the stabilizing device in accordance with the invention.

Attention is invited again to FIG. 2 where the long fabric belt 10 is shown wrapped around the cluster of stacks of articles such as boxes 16. The two ends of belt 10 have been brought around so as to overlay each other and impose the hook material bands 14 over the loop material sheet 12 in which case the loop material 14 can be pressed against the loop material 12 to thereby fasten opposite ends of the belt 10 together. Usually, the articles 16 would be mounted on some kind of a conveyance such as a cart, not shown in FIG. 2. Often, the articles are deposited on a pallet, not shown in FIG. 2, but which is mounted on a cart or lift truck, for example, before the articles are loaded on it.

The manner in which the article stabilizing belt 10 is used will now be explained. In a case where the articles are paper or fiber boxes or other soft material as in FIG. 2, the sharpened tip on the c-shaped hook 21 on strap 17 is pressed into a carton or the like as shown to anchor one end of the belt. The strap and, hence, the belt can also be anchored by inserting the hook between two boxes or hooking onto a strap or cord which is tied around a box. By grasping the upper edge of the belt 10 and pulling it in the direction in which the belt is to be wrapped around the articles, anchoring strap 17 is placed in tension as is the belt itself. In the case where the stack of articles is large, the belt 10 can be walked around the stack and placed in tension before pressing the hook material 14 into engagement with the loop material 12. Experience has shown that this is an easy maneuver to execute and that it is easy to develop adequate tension in the belt to bind the articles together securely. It will be evident that the attachment strap 17 makes it possible that only one person is needed to apply the load stabilizing belt.

Figure 2:
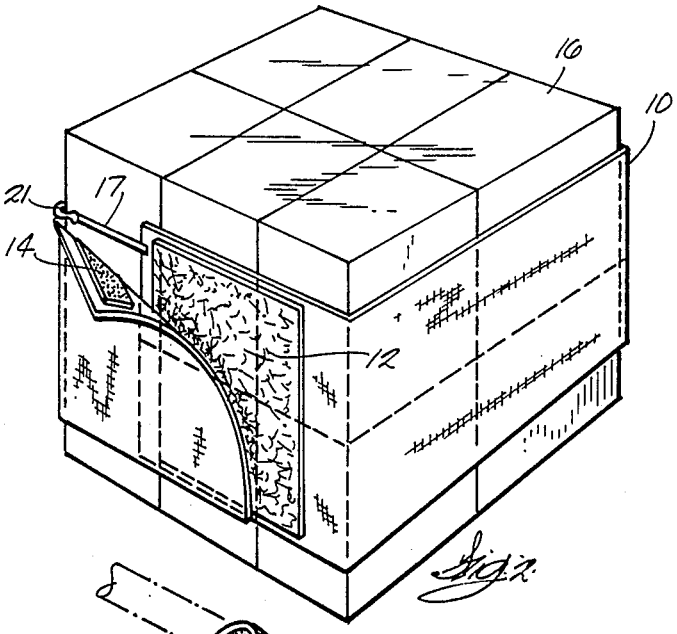
FIG. 2 shows the device wrapped around stacks of articles that form a cluster as would be the case when the articles are on a vehicle for being transported.

Normally, when the articles are bound together with belt 10 as they are in FIG. 2, there is no need for any further attachment to whatever vehicle the articles are transported on.

Figure 3:
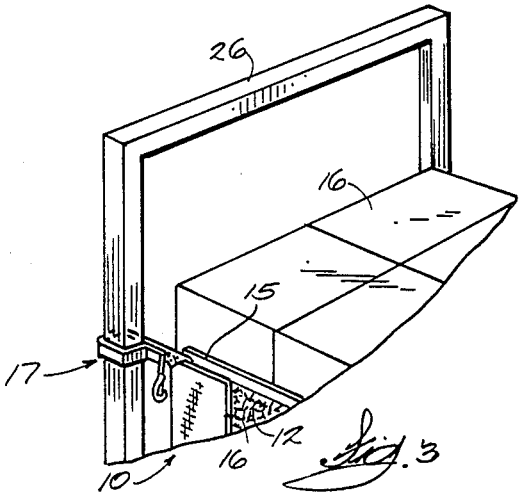
FIG. 3 shows a fragment of a cluster of articles about which the stabilizing belt is wrapped and secured to the handle of a push cart.

FIG. 3 shows stacks of articles 16 which may be on a pallet, not shown, resting on a cart, the platform of which is not visible. The cart has a handle 26 for pushing it. The end 16 of fabric belt 10 containing the hook material sheets 14 is already engaged with the loop material sheet 12 at the other end 15 of belt 10. In FIG. 3 an alternative way of anchoring one end of belt 10, that is, end 15 while the belt 10 is being wrapped around the cluster of articles 16 is shown. In this case the end 15 is first anchored by use of the hook and loop materials 20 and 19 on strap 17 itself. The two ends of strap 17 when looped around handle 26 bring the loop and hook material strips on the strap 17 into interfacing relation so they can be attached together to anchor the belt 10 while it is being wrapped around the stacks of articles 16. Actually, belt 10 could be wrapped around the vertical legs of the handle 26 in the FIG. 3 illustration if it were desired to enhance the stability of the stacks.

Figure 4:
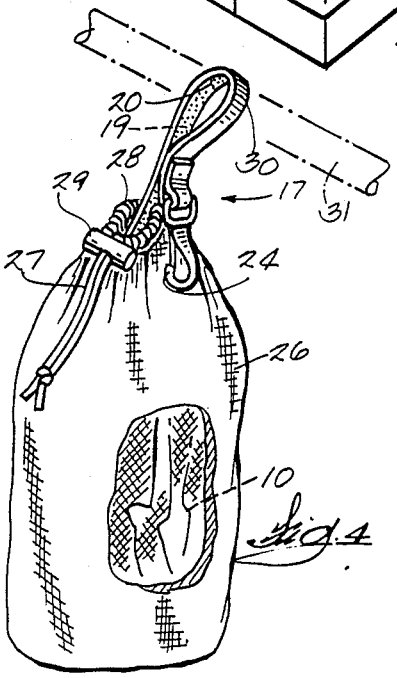
FIG. 4 shows the bag in which the stabilizing belt is stored and wherein the strap and hook assembly that is used for anchoring one end of the strap as it is being wrapped around the cluster of articles is extending from the bag to enable hanging the bag in storage and providing means for pulling the stabilizing belt out of the bag.

FIG. 4 shows how the load stabilizing belt is stored and made ready for using it with great convenience. The storage container in FIG. 4 constitutes a sack which, by way of illustration in a commercial embodiment, is comprised of a material known by the tradename "Rip-Tide" nylon. Other flexible materials could be used for the sack. A fragment of sack 26 is broken away to show the stored belt 10 inside. The mouth of the sack has a draw string 27 which passes through a hem 28 at the mouth of the sack. The draw string 27 is placed in tension to close the sack by pushing a slider 29 toward the sack in a well known manner. In storage, the strap 17 is allowed to extend out of the mouth of the sack. In FIG. 4, the strap is looped around to form a bight 30 for hanging on a bar 31 during storage. The bight 30 is closed by putting the hook material strip 20 on strap 17 into engagement with the loop material strip 19 as shown. When the stabilizing belt 10 is to be used, the bight is opened and the slider 29 is slid back to allow the mouth of the bag to open. Usually the sharpened hook tip 24 will be engaged with an article so as to permit drawing the sack 26 off of the belt 10 stored therein. When a portion of the belt has exited from the sack the upper edge of the belt can be grasped to keep the hooked strap in tension of beginning to deploy the belt around the articles.

Alternative forms of the new belt for stabilizing a cluster of articles will now be described in reference to FIGS. 5–16.

Figure 5:
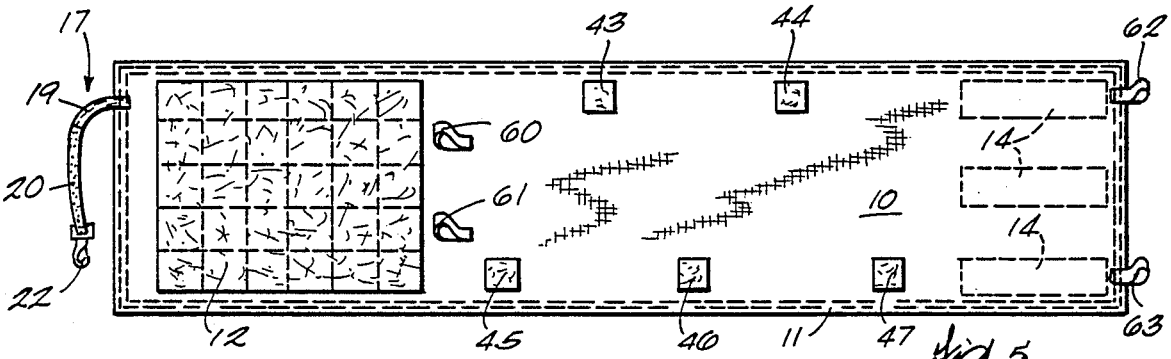
FIG. 5 is a plan view of an alternative embodiment of a device for stabilizing a cluster of articles.

Attention is invited to FIG. 5. This embodiment of the belt features elements for preventing the belt from creeping up or down on a cluster of articles which can be a problem where the articles are transported over a rough surface or have an irregular shape. Parts of the belt that are the same as the FIG. 1 embodiment are given the same reference numerals. The FIG. 5 belt comprises the basic sheet 10 composed of a tough fabric such as nylon. The edges of the belt are double folded to form a strong hem 11 and the hem is double-stitched. At one end of belt 10 a sheet of either loop or hook material 12 is sewn onto belt 10. These materials may be similar to hook and loop materials obtainable under the trademark Velcro. There are three strips of hook material sewed in this embodiment onto the other end of belt 10. A belt anchoring strap 17 is fastened by sewing at an end 18 to the strong hem on belt 10. As in the FIG. 1 embodiment, strap 17 may have a strip of hook material 19 and an adjacent strip of loop material 20 fastened to the strap. The hook material 20 can be brought around to engage with loop material 19 for the purpose of forming a loop that can be used to anchor one end of the belt through a fixed object such as to some part of a cart on which the belt is being used to stabilize a stack of articles. Strap 17 also has a hook 22 which is another way of anchoring one end of the belt to facilitate wrapping it around a stack of articles. The features thus far described relative to the FIG. 5 embodiment are basically the same as in the FIG. 1 embodiment.

In FIG. 5, however, there are some additional features including an upper row of hook or loop patches 43 and 44 and a lower row of hook or loop patches 45–47. There would be at least one hook or loop patch in the upper row and at least one hook or loop patch in the lower row. The purpose of the patches are to allow the belt to be engaged by detachable straps which respectively hold the belt against slipping up or down on a cluster of articles in transport, for example as will be explained in reference to FIG. 6.

Figure 6:
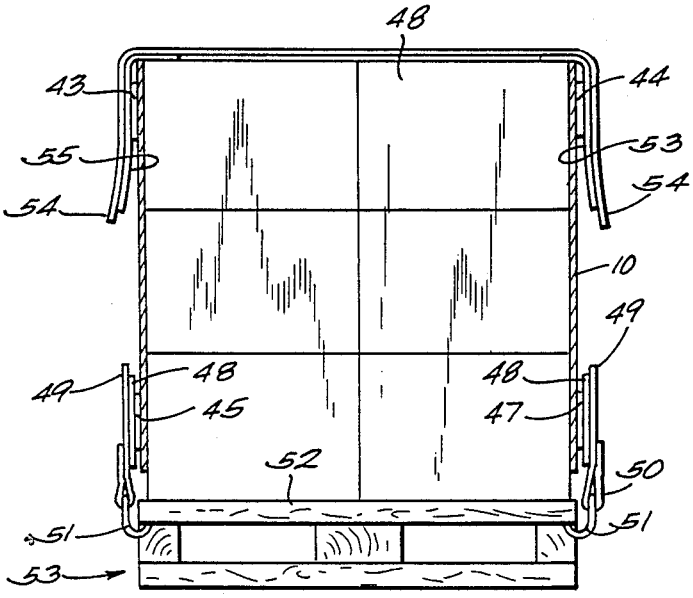
FIG. 6 is a side elevational view partly in section showing a cluster of articles retained on a pallet using a belt similar to FIG. 5 in conjunction with some additional belt retaining devices.
Figure 8:
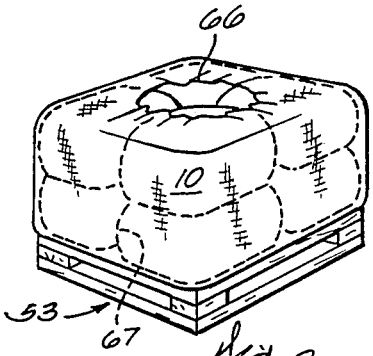
FIG. 8 shows use of the stabilizing device depicted in FIG. 7 on a cluster of articles which are standing on a pallet.

FIG. 6 shows the belt 10 of FIG. 5 in use to stabilize a cluster of articles 48 by being wrapped around the articles. In this figure, patch 47 for example, is engaged by a patch 48 which is sewed onto a short strap 49. If the patch 47 is loop material, patch 48 will, of course, be hook material and vice versa. Flexible strap 49 has a loop 50 formed at one of its ends and there is a hook 51 connected to the loop. Hook 51 is shown in FIG. 6 as being hooked under a board 52 comprising part of a pallet 53. A similar assembly of a flexible strip 49 and a hook 51 is shown on the left side of cluster of articles engaged with the hook or loop material 45 which is joined with the counterpart loop or hook material 48 on the strap. The straps 49 and hooks serve to hold the fabric belt 10 against slipping upward on the cluster of articles. After the user wraps the belt 10 around the cluster of articles 48 and engages the large area of loop material 12 with the three strips 14 of hook material, the hooks 51 are engaged with the pallet or anything else on which the articles are supported and the hook and loop materials on the strap 49 and belt 10 can be engaged to preclude the belt from slipping upwardly.

The upper row of loop or hook patches 43 and 44 in FIG. 5 are used to prevent the belt from slipping downwardly on a cluster of articles such as in FIG. 6. In this figure, typical patch 44 is presented toward a strip of hook or pile material 53 which is sewed onto a srap 54. The other end of the strap has a strip 55 of hook or pile material sewn to it and this material engages the counterpart hook or pile material 43 or 44 in the upper row of patches on belt 10. The strap 54 is used to prevent belt 10 from slipping downwardly along the cluster of articles 48. It will be evident that the way to use the strap 54 is to lay it on top of the stack of articles and cause the elongated strips of hook or pile material 53 and 55 to engage with the patches 43 and 44 on the belt 10 to put the strap 54 in sufficient tension to prevent the belt from sagging downwardly.

Although holding the belt 10 in FIG. 5 against slipping upwardly or downwardly by means of straps engageable with patches 43-47 as demonstrated in connection with FIG. 6, is done with Velcro type hook and loop attachments other types of attachments could be used. For example, engaging another hook, not shown, on hold down straps 49 with grommets, not shown, in the belt 10 could be used although straps having hook or loop material engaged with patches of hook or loop material, respectively, are clearly preferred because they are much more adaptable to clusters of articles that have different dimensions since the length of the strip of hook or pile material 55 on the strap in FIG. 6 allows for engaging with a patch along different zones on the strap.

It should be observed that short straps 49 having hook 51 at their ends cannot only be attached to the patches 45–47 but they can also be attached to the hook or loop material 12. Then, when the end of the belt 10 having the "Velcro" strips 14 is wrapped around the cluster of articles to overlay and engage with the "Velcro" material 12 some of the straps 49 may be overlaid but that does not interfere with their capability for holding the belt 10 down.

Likewise, the straps 54 which hold up the belt 10 can not only be attached to patches 43 and 44 in the upper row but they may also be attached to the "Velcro" material 12. Straps 54 may also be lengthened and hooks, such as hooks 51, can be attached to their ends so that the hooks can engage the pallet to provide even greater support for the cluster of articles.

The belt 10 in FIG. 5 also has some loops 60-63 fastened to it. These loops are called tugging loops because they afford a person who is wrapping a cluster of articles with the belt an opportunity to grip the belt by means of the loops and pull it taut before engaging the loop and hook materials 12 and 14.

Figure 7:
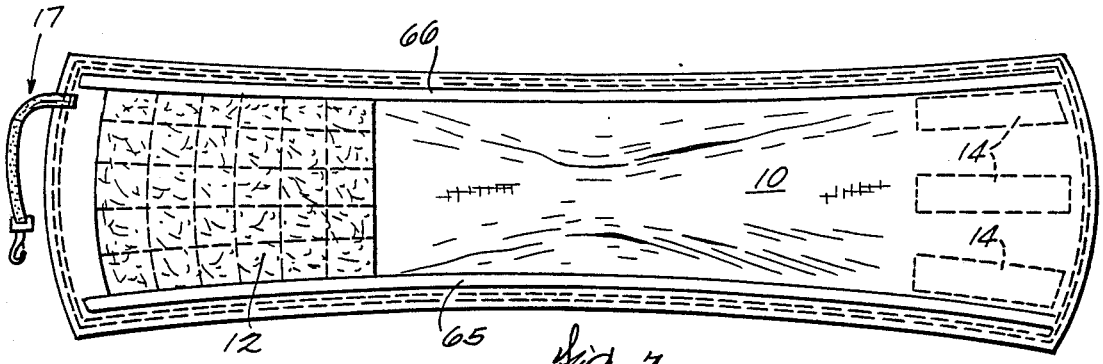
FIG. 7 is a plan view of another embodiment of article stabilizing device.
Figure 9:
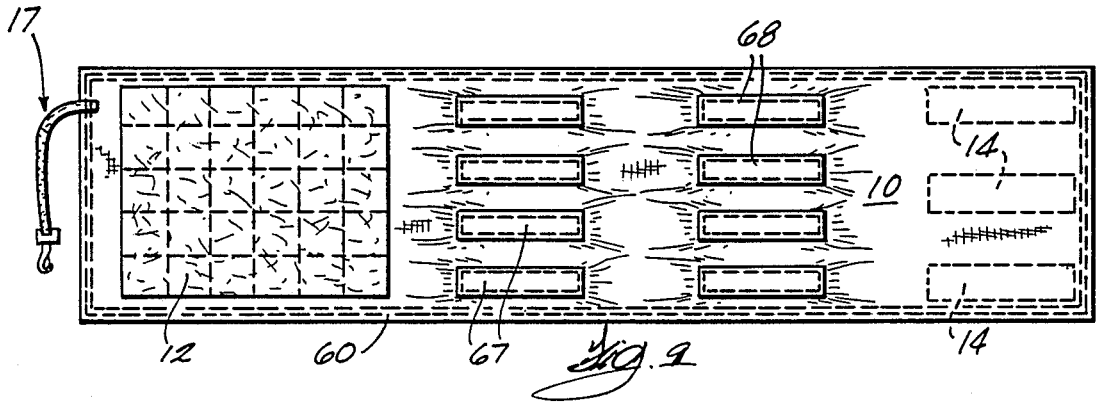
FIG. 9 is another embodiment of the article stabilizing device.

FIG. 7 shows another model of the belt 10. Parts that are similar to the FIGS. 1 and 5 embodiments are given to the same reference numerals. The FIG. 5 model is especially useful in cases where a stack of filled bags, for example, are on a cart or pallet that must be transported. Bags do not present nice, flat surfaces for the belt 10 to lie against. The belt shown in FIG. 7 is superior for such cases. This belt has the loop and hook components 14 and 12 as in the FIG. 5 embodiment. However, the long edges of the belt have bands 65 and 66 of elastic material sewed to them. These elastic bands are sewn onto the belt 10 when the elastic and fabric belt 10 are stretched so when the belt is set free the edges contract and shorten under the influence of the contracting bands 65 and 60 so the belt assumes the shape depicted in FIG. 7. When the belt 10 of FIG. 7 is wrapped around bags 67 as in FIG. 8, the top and bottom edges of the belt will be kept in tension by the elastic bands 66 and 65 so as to prevent the belt 10 from shifting up or down. The belt 10 in FIG. 9 also uses elastic bands to provide a contractile force when the belt is wrapped around a cluster of articles that present an irregular contour. In FIG. 9, there are columns of elastic bands 67 and 68 which are sewn onto belt 10 when the bands are stretched and in tension. At that time the bands 67 and 68 are lying flat on the belt 10. When the belt is unclamped or released, bands 67 and 68 contract and substantial rugosity develops in the central region of the belt. Thus, there is inherent tension in the belt so that when it is being pulled and wrapped around a cluster of articles the bands are stretched out and are kept in tension when the "Velcro" components 37 and 38 are overlaid and engaged. Thus, the tension in the belt causes the belt to conform to the contours of the cluster of articles and stability of the cluster is greatly enhanced.

Figure 10:
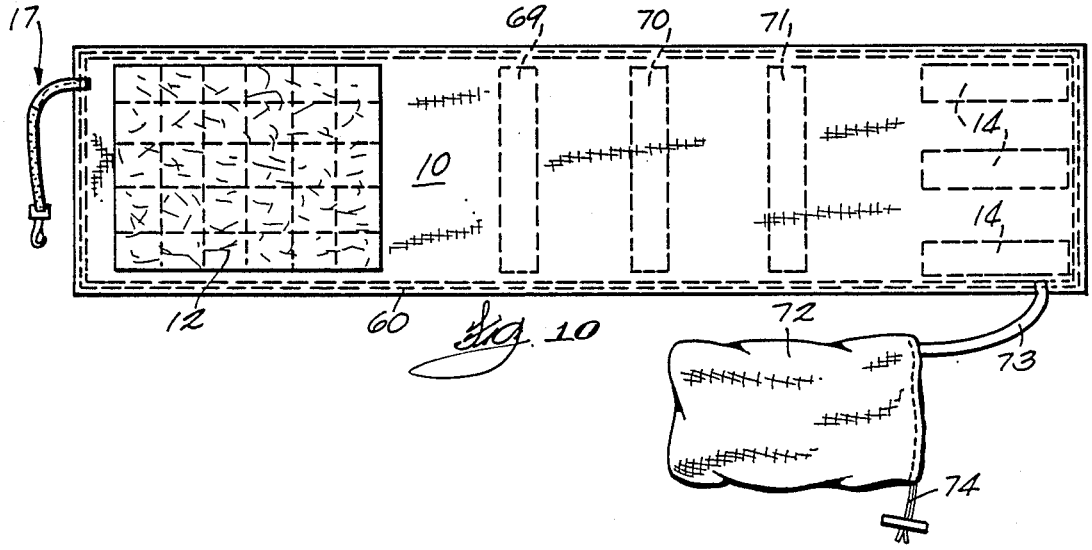
FIG. 10 is a plan view of an embodiment of a stabilizing device in combination with a bag for storing the device.

The FIG. 10 model is based on the same basic belt 10 having "Velcro" components 37 and 38 attached on opposite sides and having a double-folded hem 60 at the edges to increase strength. The FIG. 10 embodiment has two features which can also be employed or combined in other models of the belt. The first feature is to have some strips 69, 70 and 71 attached to belt 10. The strips can be rubberized fabric which frictionally engage the articles with which they interface to prevent the belt from crawling up. It is preferable for the strips to be sufficiently rigid to act as a stiffener to inhibit horizontal wrinkling when the belt is stretched. The strips 69–71 need not be perfectly straight, they can have a serpentine or zigzag configuration constituted by rubber bands as are used in some articles of clothing such as to hold the clothing up around the waist of an individual.

The FIG. 10 embodiment also features means for putting the belt 10 in condition for storage. For this purpose a bag 72 is fastened to the belt 10 by means of a leash 73. The bag has a drawstring 74 installed in it so that by pulling on the string, the top or open end of the bag will be drawn closed. For the sake of neatness and compactness, the belt 10 can be made ready for storage by simply stuffing it into bag 72 and pulling the drawstring 74 taut.

Figure 12:
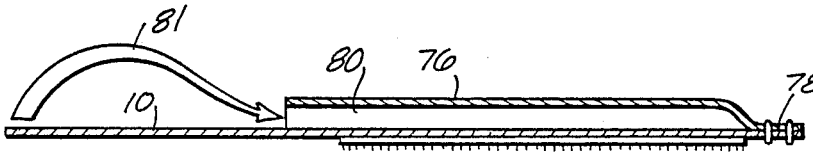
FIG. 12 is a section taken along a line corresponding with 12—12 in FIG. 11.
Figure 11:
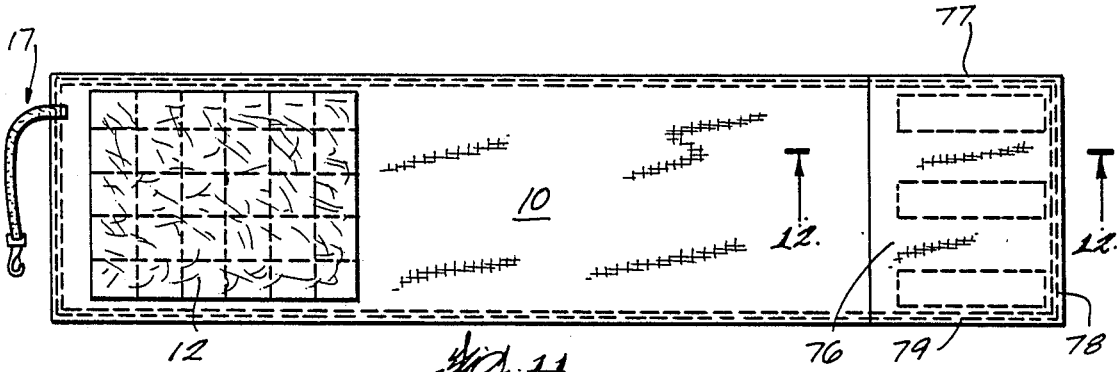
FIG. 11 is a plan view of another embodiment of the article stabilizing device which has a built-in pocket for allowing the device to be rolled up and inserted in the pocket for placing it in storage condition.

Another model of the belt, which is provided with a different means for putting the belt in condition for storage, is shown in FIGS. 11 and 12. In FIG. 11, there is a sheet of fabric 76 sewn at three of its edges 77, 78 and 79 to the hemmed edges of belt 10. The sheet of fabric 76 is greater in width than the width of the belt before the fabric is sewed on so that the sheet forms a pocket 80 which is shown in FIG. 12. As the arrow 81 indicates, the belt can be rolled up and pushed into pocket 80 or the belt can simply be stuffed into the pocket in a crumpled fashion.

Figure 13:
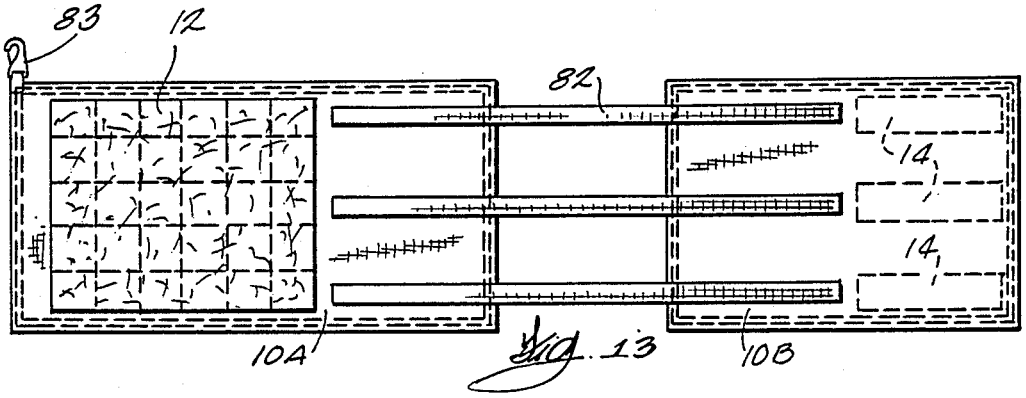
FIGS. 13–16 are, respectively, plan views of modified embodiments of the article stabilizing device.

The FIG. 13 model of the belt has it segregated into two separate sections 10 A and 10 B. Section 10 A has one component of "Velcro" material attached to it and section B has another component 14 fastened to it. This model is especially adapted for encompassing very irregularly shaped loads and concurrently restraining the articles with strong elastic bands, such as the one marked 82, which span between sections 10 A and 10 B of the belt. In this model, the usual anchoring strap, such as strap 17 in other embodiments, is replaced by a hook 83 which facilitates fastening one end of the belt to a stationary object while the belt is being stretched around a cluster of articles on a pallet or cart, for example. A hook 83 fastened directly to a corner of the belts as in FIG. 13 could be used in any of the embodiments of the belt shown herein.

Figure 14:
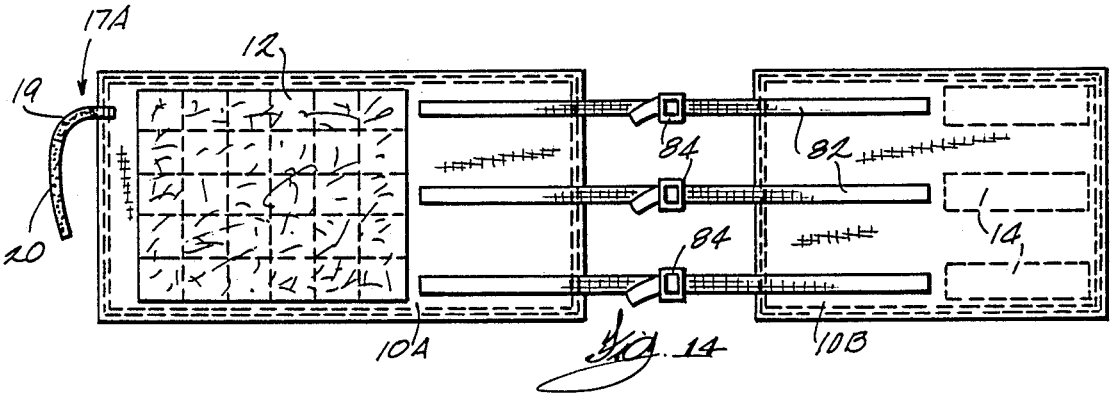

The FIG. 14 embodiment is similar to FIG. 13 in that it has the belt divided into two sections 10 A and 10 B connected by elastic bands which are again marked 82. In the FIG. 14 model, however, the elastic bands are made in two parts and are connected by a slide buckle such as the one marked 84. The slide buckle allows for changing the length of the bands 82. This makes the belt adaptable to very irregularly shaped clusters of articles. For instance, some loads or clusters may be larger in their midsections than at their ends, such as is the case with a barrel-shaped load. In such case, the upper and lower bands 82 could be shortened by adjusting buckles 84 or the center band could be lengthened relative to the other bands. In FIG. 14, the anchoring strap 17 A does not terminate with a hook such as in other embodiments including FIG. 1 where the hook is marked 22. In FIG. 14, the anchoring strap has only the series of "Velcro" patches 19 and 20 which can be engaged with each other after having been wrapped around some stationary element to secure one end of the belt 10 while the belt is being pulled around the cluster of articles for the purpose of engaging "Velcro" components 12 with "Velcro" components 14.

Figure 15:
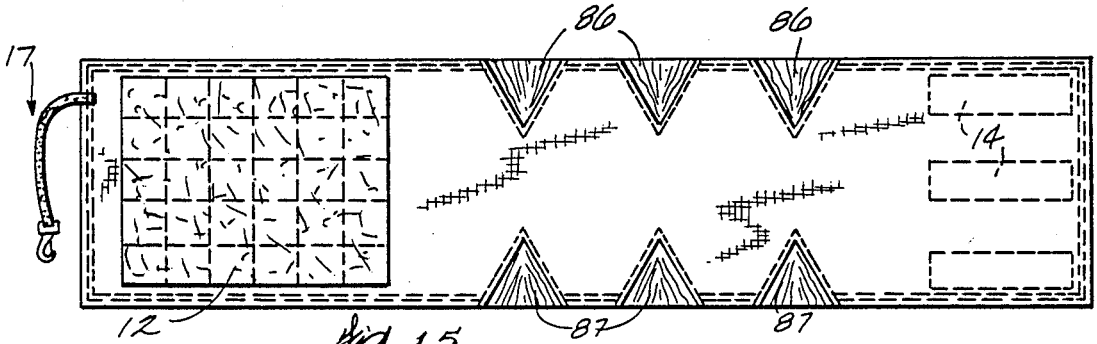

The FIG. 15 embodiment is comprised of the basic belt 10 and "Velcro" components 12 and 14 as in several embodiments which have been described. In the FIG. 15 embodiment, the opposite long edges of the belt 10 are provided with v-shaped inserts 86 and 87 composed of elastic material. These inserts are sewn into the edges of the belt in a stretched condition so they contract after being sewn when the belt is set free. The triangular elastic inserts 86 help to maintain the belt 10 in tension so it will hold a cluster of articles tightly.

Figure 16:
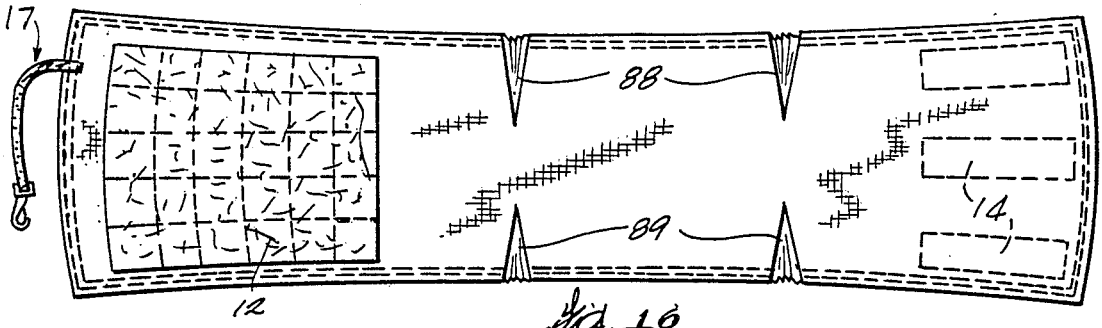

The FIG. 16 model is basically the same as the preceding model. In FIG. 16, the long edges of the belt 10 have pleats such as those marked 88 and 89. This design is especially useful in securing clusters or single articles which may be small in the central region and larger in the regions above and below the central region.

It should be understood that although some of the new features of the stabilizing belt were described in reference to a particular embodiment or drawing figure the feature or features can be used in other embodiments, too. For example, the loop or hook material patches 43 and 44 shown in FIG. 5 for holding the belt 10 up or down, respectively, could be applied to the FIG. 7, 9, 11, 15 and 16 embodiments. The tugging loops 60–63 of FIG. 5 could be applied to the other embodiments, too. If the loop and hook patches 43 and 44 are applied to embodiments of the belt 10 other than the FIG. 5 embodiment, the hold up straps 55 and the hold down straps having the hooks 51 in FIG. 6 can be used with other embodiments. As another example, the v-shaped elastic inserts 86 of FIG. 15 and the pleats 88 of FIG. 16 might be used in the FIG. 5, 9, 10 or 11 embodiments. It should be clear that the features can be variously combined.

Although a preferred embodiment of the invention has been described in detail, such description is intended to be illustrative rather than limiting, for some of the parts of the stabilizing device can be variously modified so the scope of the invention is to be determined only be interpreting the claims which follow.

We claim:

1. A device for stabilizing a cluster of articles, comprising:

an elongated belt of flexible fabric material having one pair of edges extending over the length of said belt and edges at the beginning and terminal ends of said belt which are directed substantially transversely to said long edges, a sheet of hook material fastened to one side of said belt, a sheet of loop material fastened to the other side of said belt and displaced lengthwise of said belt from said hook material, an attachment strap, substantially narrower than said belt, having one end fastened to one end of said belt and extending lengthwise from said beginning end of the belt so as to terminate in a free end, means attached to said free end of said strap for attaching said strap to a said article or other object to support said one end of said belt and facilitate wrapping said belt around said cluster of articles until said hook and loop materials can be pressed into engagement, and zones of hook and loop materials fastened adjacent each other on the said attachment strap for being engaged with each other to form a bight on which said strap and the belt to which it is fastened can be hanged.

2. The device according to claim 1 wherein said belt is comprised of nylon fabric.

* * * * *